US008016609B1

(12) United States Patent
Lin

(10) Patent No.: US 8,016,609 B1
(45) Date of Patent: Sep. 13, 2011

(54) ELECTRICAL DEVICE

(75) Inventor: I-Thun Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/898,679

(22) Filed: Oct. 5, 2010

(30) Foreign Application Priority Data

Aug. 18, 2010 (TW) ..... 99127503 A

(51) Int. Cl.
*H01R 12/00* (2006.01)

(52) U.S. Cl. ..... 439/483; 439/946

(58) Field of Classification Search ..... 439/630, 439/862, 137, 138, 374, 385, 483, 946
See application file for complete search history.

(56) References Cited

U.S. PATENT DOCUMENTS 4,702,542 A * 10/1987 Noyes ..... 439/347
6,050,848 A * 4/2000 Yao ..... 439/483
6,219,256 B1 * 4/2001 Wu ..... 361/801
6,522,534 B1 * 2/2003 Wu ..... 361/679.4
6,612,853 B2 * 9/2003 Wu ..... 439/136
7,133,296 B2 * 11/2006 Choi et al. ..... 361/798
7,156,683 B2 * 1/2007 Gupta et al. ..... 439/352
7,422,461 B2 * 9/2008 Chen ..... 439/326
7,482,680 B2 * 1/2009 Brewer et al. ..... 257/678
7,486,523 B2 * 2/2009 Wu et al. ..... 361/747
7,881,051 B2 * 2/2011 Kim ..... 361/679.31
2003/0083686 A1 * 5/2003 Freeman et al. ..... 606/181
2005/0250369 A1 * 11/2005 Ferderer ..... 439/352

* cited by examiner

*Primary Examiner* — Neil Abrams
*Assistant Examiner* — Phuong Nguyen
(74) *Attorney, Agent, or Firm* — Clifford O. Chi

(57) ABSTRACT

An electrical device includes a housing having a receptacle defined therein, an USB connector received in the receptacle, two first retaining members and a second retaining member. The USB connector includes a front end for coupling with a coupling USB connector and a rear end retainably received in the receptacle. The first retaining members and the second retaining member each includes a V-shaped profile. The first retaining members respectively clamps opposite lateral sides of the USB connector. The second retaining member clamps the rear end.

7 Claims, 4 Drawing Sheets

ELECTRICAL DEVICE

BACKGROUND

1. Technical Field

The present disclosure relates to an electrical device with an USB connector.

2. Description of Related Art

An electrical device typically includes a housing and an USB connector received in the housing. The USB connector is used to as a bridge for connecting other electrical devices. The USB connector includes a front end and a rear end. The front end is configured for coupling with other coupling USB connector, and the rear end is fixed in the housing.

However, because the rear end of the USB connector is fixed to the housing, if an improper force is applied on the USB connector when in use, the USB connector may be bent or cracked, and a circuit board and/or wires in the USB connector may be damaged.

What is needed therefore is an electrical device addressing the above-mentioned problems.

BRIEF DESCRIPTION OF THE DRAWINGS

The components of the drawings are not necessarily drawn to scale, the emphasis instead being placed upon clearly illustrating the principles of the embodiments of the electrical device. Moreover, in the drawings, like reference numerals designate corresponding parts throughout several views.

DETAILED DESCRIPTION

Figure 1:
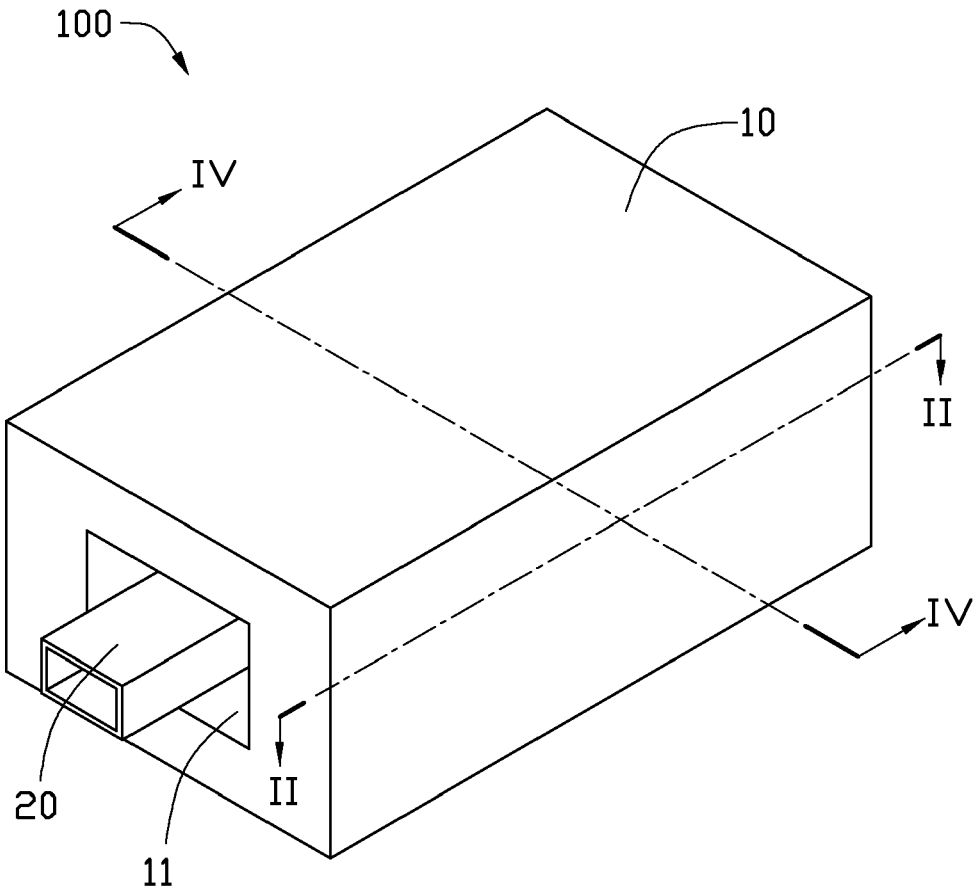
FIG. 1 is an isometric view of an electrical device according to an exemplary embodiment of the present disclosure.
Figure 2:
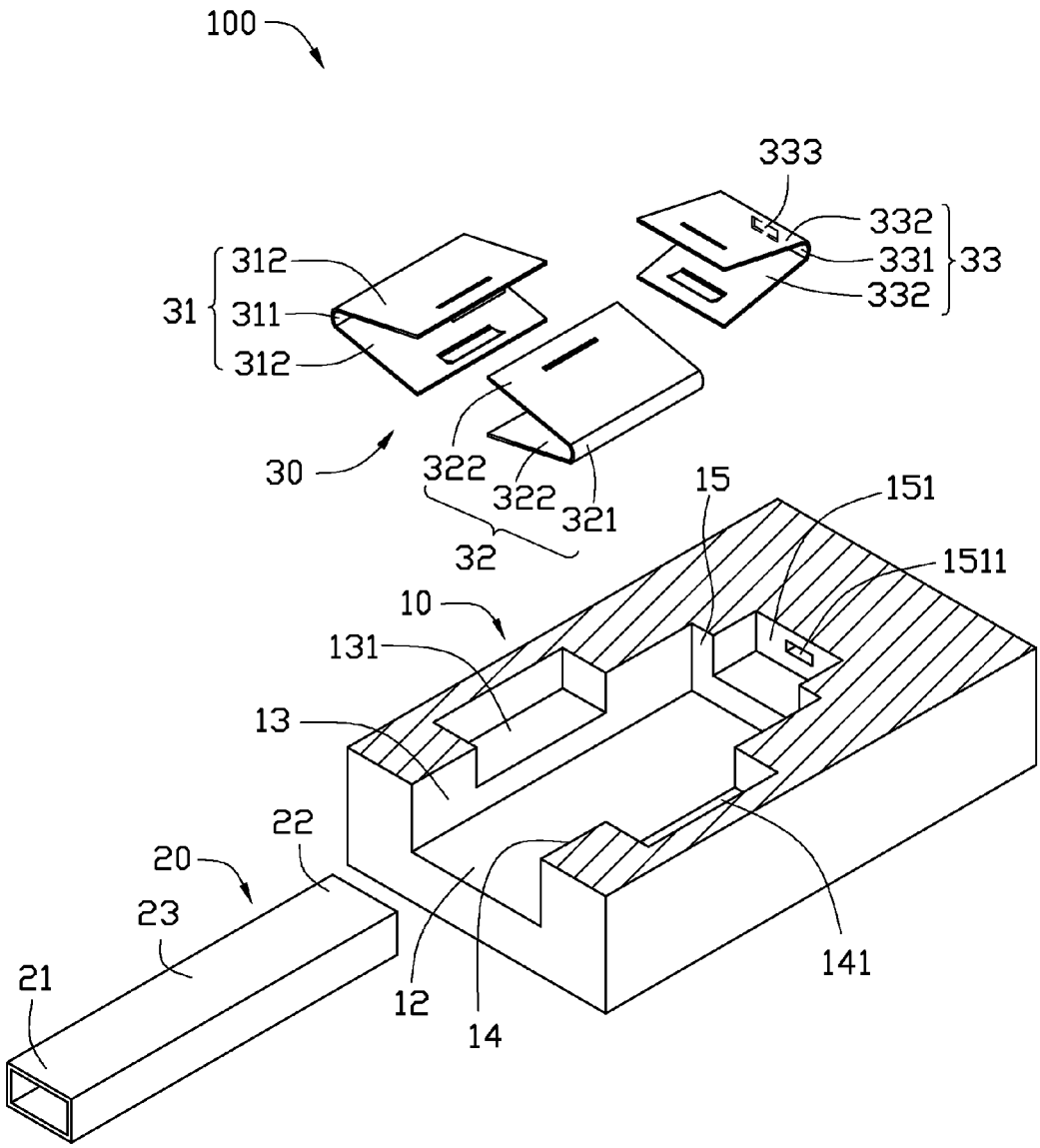
FIG. 2 is an exploded view of the electrical device of FIG. 1, cut away along line II-II.
Figure 3:
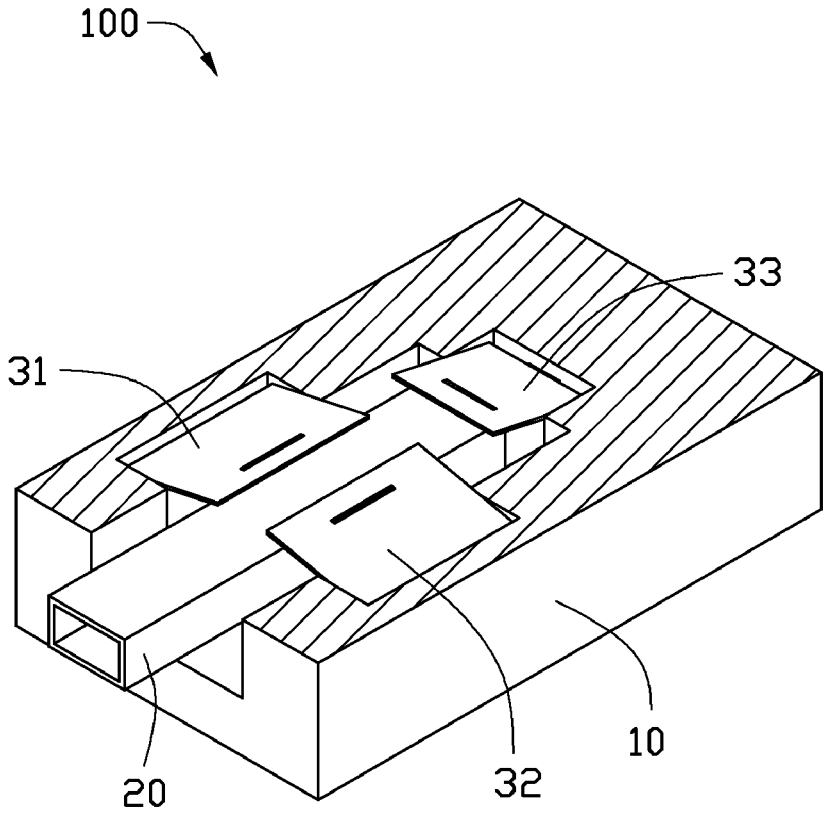
FIG. 3 is an assembled view of the electrical device of FIG. 2.
Figure 4:
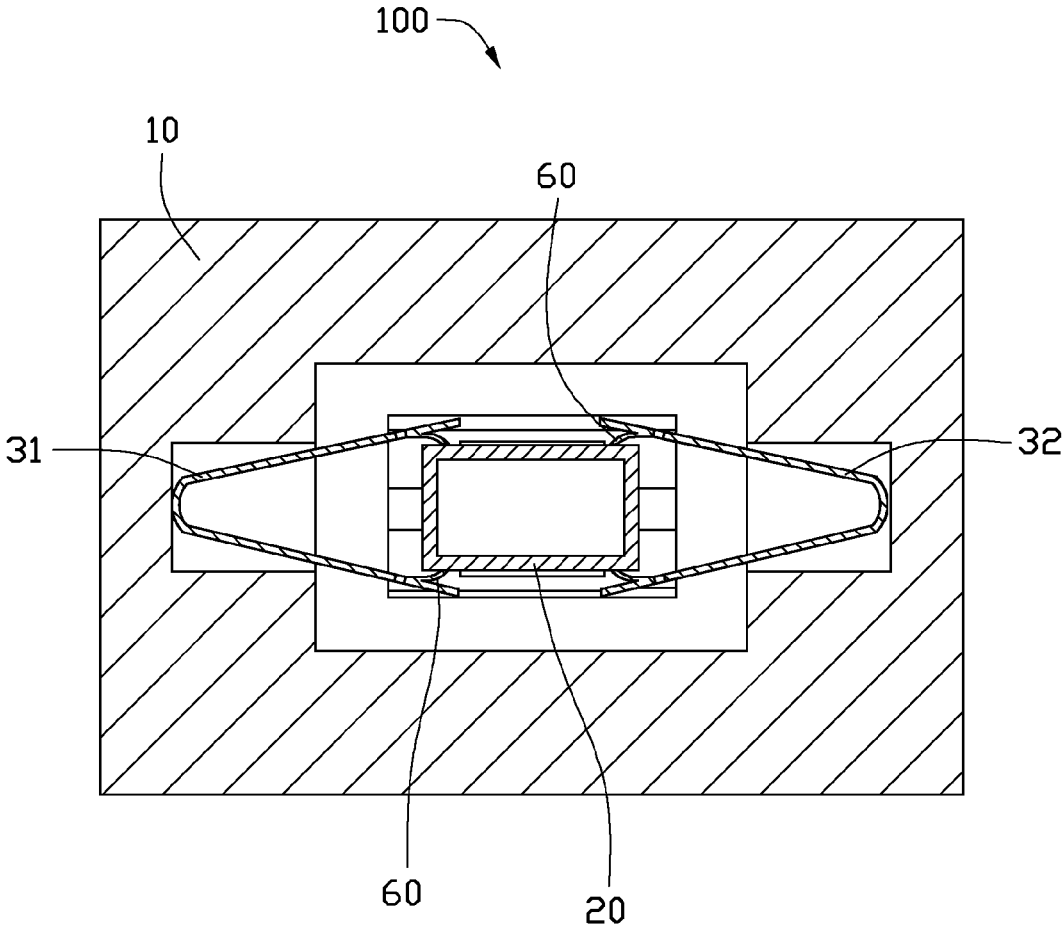
FIG. 4 is sectional view of the electrical device of FIG. 1, taken along line IV-IV.

Referring to FIGS. 1-4, an electrical device 100, according to an exemplary embodiment, is shown. The electrical device 100 includes a housing 10, an USB connector 20, and a retaining unit 30.

The housing 10 is substantially rectangular and hollow. The housing 10 defines a receptacle 11 therein and an opening 12 at an end surface thereof in communication with the receptacle 11. The housing 10 includes a first inner surface 13, a second inner surface 14, and a third inner surface 15. The first inner surface 13 and the second inner surface 14 are opposite to each other, the third inner surface 15 interconnects the first inner surface 13 and the second inner surface 14 and is opposite to the opening 12. The first inner surface 13 defines a first recess 131, the second inner surface 14 defines a second recess 141, and the third inner surface 15 defines a third recess 151. In this embodiment, each of the first recess 131, the second recess 141 and the third recess 151 are substantially cuboid. Alternatively, the first recess 131, the second recess 141, and the third recess 151 can be other shapes. A bottom surface of the third recess 151 defines a first through hole 1511.

The USB connector 20 includes a front end 21, a rear end 22 opposite to the front end 21 and a medial portion 23 between the front end 21 and the rear end 22. The front end 22 is configured for coupling with a coupling USB connector (not shown) for transmitting signals. The USB connector 20 may include circuit board(s) and/or wires (not shown) therein for transmitting and/or processing signals.

The retaining unit 30 includes a first resilient retaining member 31, 32 and a second resilient retaining member 33. The first retaining member 31, 32 and the second retaining member 32 have substantially V-shaped profiles. The first retaining member 31 includes a curved portion 311 and two arms 312 interconnected by the curved portion 311 The other first retaining member 32 includes a curved portion 321 and two arms 322 interconnected by the curved portion 321. The second retaining member 33 includes a curved portion 331 and two arms 332 interconnected by the curved portion 331. The curved portion 331 of the second retaining member 33 further defines a second through hole 333 corresponding to the first through hole 1511 in the bottom surface of the third recess 151. Preferably, each of the first retaining member 31, 32 and the second retaining member 33 includes two jaw portions 60 respectively extending from the arm 312 (322, 332) thereof. The jaw portions 60 are extended toward each other.

In assembly, the curved portions 311, 321, 331 are correspondingly inserted into and fixed in the first recess 131, the second recess 141, and the third recess 151, and the arms 312, 322, 332 are extended to the receptacle 11. The first through hole 1511 and the second through hole 333 are aligned with each other. The front end 21 of the USB connector 20 is inserted into the receptacle 11 passing through the opening 12 and elastically supported between the two arms 332 of the third retaining member 33. The rear end 22 of the USB connector is extended out of the receptacle 11 through the opening 12. The medial portion 23 of the USB connector 20 is supported between the two arms 312 of the first retaining member 31 and the two arms 322 of the second retaining member 32. The jaw portions 60 of the first retaining member 31, the second retaining member 32, and the third retaining member 33 are in contact with the lateral portions and the rear end 22 of the USB connector 20 to clamp the USB connector 20 in the receptacle 11. Thus, the USB connector 20 is spaced from the inner surface 13 of the housing 10 and is suspended in the receptacle 11.

Alternatively, the retaining unit 30 may further include one or more retaining members structured similar to the first retaining member 31, 32 and the third retaining member 33. Correspondingly, the housing 10 may define one or more recesses in the inner surface thereof structured similar to the first recess 131, the second recess 141, and the third recess 151. In other embodiments, the retaining members can be directly fixed on the inner surface of the housing 10 and the recesses omitted.

Because the USB connector 20 is elastically held in the receptacle 11 by the retaining unit 30, if the USB connector 20 of the connector 100 collides with other objects, or if a user applies too much force on the connecter 100, the USB connector 20 can move a distance and/or rotate an angle relative to the housing 10 to counteract the forces. If the USB connector 20 acted on by some force and shifted out of position it can be moved to the original position under the elastic force of the retaining unit 30. Therefore, the connector 100 can protect the circuit board and/or wires in the USB connector 20 from damage, and the transmitting capability of the connector 100 is ensured.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An electrical device comprising:

a housing comprising a receptacle defined therein;

a USB connector received in the receptacle, the USB connector comprises a front end for coupling with a coupling USB connector and a rear end retainably received in the receptacle;

two resilient first retaining members each comprising a V-shaped profile, the first retaining members respectively clamping opposite lateral sides of the USB connector, and a second retaining member comprising a V-shaped profile, the second retaining member having a slot and clamping at the rear end; the rear end of the USB connector is received through the slot for mating to a corresponding connector;

the receptacle comprises an opening, the second retaining member faces toward the opening;

each of the first retaining members comprises two arms and two jaw portions respectively extending from the arms, the jaw portions extending toward each other and configured for clamping lateral portions of the USB connector.

2. The electrical device of claim 1, wherein the USB connector is spaced from the arms of the first retaining members.

3. The electrical device of claim 1, wherein the second retaining member comprises two arms and two jaw portions respectively extending from the arms thereof, the jaw portions extending toward each other and configured for clamping the rear end of the USB connector.

4. The electrical device of claim 3, wherein the USB connector is spaced from the arms of the second retaining member.

5. The electrical device of claim 1, wherein the first and second retaining members are arranged in the receptacle.

6. The electrical device of claim 5, wherein the USB connector is suspended in the receptacle and retainably supported by the first and second retaining members.

7. The electrical device of claim 6, wherein the housing comprises an inner surface in the receptacle, and the USB connector is spaced from the inner surface.

* * * * *